United States Patent [19]

Henning et al.

[11] 4,313,758

[45] Feb. 2, 1982

[54] METHOD FOR ADDING UNALLOYED MAGNESIUM METAL TO MOLTEN CAST IRON

[75] Inventors: William A. Henning, Lewiston; Henry F. Linebarger, Amherst, both of N.Y.

[73] Assignee: Union Carbide Corporation, New York, N.Y.

[21] Appl. No.: 192,702

[22] Filed: Oct. 1, 1980

[51] Int. Cl.[3] ..... C22C 33/08

[52] U.S. Cl. ..... 75/130 R; 75/53; 75/58

[58] Field of Search ..... 75/53, 58, 130 R

[56] References Cited

U.S. PATENT DOCUMENTS

| | | | |
|---|---|---|---|
| 3,902,892 | 9/1975 | Easwaran | 75/58 |
| 4,060,407 | 11/1977 | Jackmon | 75/130 R |
| 4,173,466 | 11/1979 | McLaughlin | 75/130 R |
| 4,224,069 | 9/1980 | Shea | 75/58 |

*Primary Examiner*—P. D. Rosenberg
*Attorney, Agent, or Firm*—John R. Doherty

[57] ABSTRACT

Finely sized unalloyed magnesium metal is blended with finely sized ferrosilicon alloy. The blended mixture is placed in metal containers and plunged into molten cast iron.

4 Claims, No Drawings

METHOD FOR ADDING UNALLOYED MAGNESIUM METAL TO MOLTEN CAST IRON

The present invention is directed to the addition of magnesium to cast iron. More particularly the present invention is directed to the addition of unalloyed magnesium metal to a molten base iron.

It is a well known practice to add magnesium to a molten base iron to nodulize the graphite which precipitates during cooling and solidification of the iron, i.e., to produce ductile iron also known as nodular iron.

Many techniques have been tried at using pure, i.e., unalloyed magnesium metal to produce ductile iron, e.g., by addition to molten base iron in pressurized vessels, converter vessels, and the plunging of refractory coated magnesium ingots. In the production of commercial castings, the success of these and other methods has been severely limited due to low and erratic magnesium efficiency, i.e., magnesium recovery, on account of the low specific gravity and low boiling point of elemental Mg, 1106° C. at one atmosphere pressure, as compared to the relatively high temperatures of the molten base iron being treated, 1370° to 1650° C. The previously tried techniques have attempted to control the rate of the magnesium addition and its sensitivity to process variables, and hence, the ultimate efficiency, i.e., recovery of the magnesium addition. Ductile irons produced using pure unalloyed magnesium have been found prone to being carbidic and therefore difficult to machine.

Considerable improvements in magnesium efficiency, consistency of recovery, and the reduction of iron carbides are known to be realized by nodulizing the graphite in the base melt with various grades of magnesium ferrosilicon, MgFeSi, which most commonly contain 3% to 12% magnesium. To some ductile iron producers, particularly those using silica lined induction furnaces, use of the MgFeSi alloys creates certain problems because of the relatively high silicon content of these alloys. In order to accommodate use of these alloys, the induction melter must lower the silicon levels of his base iron, which, in turn, can lead to increase furnace lining erosion. High carbon levels in the base metal, with the lower Si contents, will act to reduce the $SiO_2$ in the lining and thereby decrease service life of the lining.

It is an object of the present invention to provide a method for adding unalloyed magnesium to molten base iron melts which results in high magnesium recoveries and does not require substantial adjustment of the silicon content of the base iron melt composition.

Other objects will be apparent from the following description and claims.

The present invention utilizes a mechanical blend of a suitably sized granular ferrosilicon or ferrosilicon base alloy, e.g., MgFeSi, with a suitably sized source of unalloyed magnesium metal. The blended mixture is placed in containers, e.g., cans, suitably made of steel; and the mixture containing cans are submerged, e.g., using standard foundry plunging apparatus, into molten base iron having a typical base iron composition of 3.5 to 4% and 1.5 to 2.0% Si. It is believed that due to the fine size of the relatively slow dissolving ferrosilicon base alloy, molten metal cannot readily penetrate through the interstices of the blended submerged material, thus causing continuous dissolution and reaction between molten iron and the unalloyed magnesium material to take place primarily and gradually at the diminishing outer surface of the blended mixture. The dissolution and reaction rate between the molten iron and the unalloyed elemental magnesium component is thus believed to be controlled and moderated, inasmuch as the elemental magnesium is gradually presented to the molten metal at a multiplicity of small reaction and dissolution sites during the period of time that the blend of magnesium and ferrosilicon based alloy is gradually dissolving in the base iron melt. A test of a blend containing 24% by weight Mg (20% unalloyed Mg and 4% Mg from suitably sized 6% MgFeSi) showed a total Mg recovery in the iron melt of 33%. Experience indicates there is no substantial difference in the "fade" of magnesium (loss of magnesium from the iron melt with time) as a function of the source of magnesium e.g., whether alloyed or elemental. Other related test work has shown Mg recoveries from the fine-sized 6% MgFeSi to be about 40% when it is plunged alone. Based on the foregoing it can be calculated that the magnesium recovery from the elemental magnesium is approximately 31%. Previous techniques of introducing unblended unalloyed Mg under similar conditions would be expected to yield only 10–15% Mg recovery.

As is known to the art, small amounts of rare earth elements that could be present in the ferrosilicon base alloy, e.g., MgFeSi component of the blend, lend an inoculating effect to the iron melt, thus reducing the carbide forming tendencies of the pure Mg component. Thus in an embodiment of the present invention the ferrosilicon base alloy constituent contains such known inoculating elements.

The silicon levels in the base iron can be significantly increased as compared to levels required when using MgFeSi as the sole source of magnesium addition. A blend of unalloyed magnesium with MgFeSi in accordance with the present invention increased melt Si levels by only 0.20%, whereas, as much as a 1.0% Si increase may be observed if MgFeSi alone is used as the source of magnesium. Therefore, the silicon concentration of the base iron can be greater. Previously described problems encountered due to low levels of base iron silicon can be reduced. Many previous techniques used to introduce materials having a high magnesium concentration or pure magnesium to base irons are highly inflexible in that the size, shape, and weight of the additon is fixed by the supplier. With the present invention, there is a great deal of flexibility. The concentration of unalloyed magnesium in the blend can be adjusted very easily simply by mixing in more or less elemental magnesium into the blend as it is being prepared. Alternatively, magnesium concentration in the blend may be kept constant, and more or less of the blend placed into the container being used for plunging. The unalloyed magnesium content of the blend can range from 4 to 40% by weight, preferably 4 to 25% by weight of the total weight of unalloyed magnesium and ferrosilicon base alloy.

A test using the present invention showed that total Mg recoveries of 50% are attained using a mixture blended to approximately 7% total Mg (4% of the blend as unalloyed magnesium). Even when increasing the total Mg content of the blend to 24% (20% of the blend as unalloyed magnesium), total Mg recoveries of 33% are realized with about 31% of the unalloyed Mg being recovered and approximately 40% of the Mg in the MgFeSi being recovered based on the method of calculating magnesium recoveries hereinabove described.

The ferrosilicon base alloy component should be at least 90% by weight about ⅜ inch and finer and is suitably sized 8 to 200 mesh and suitably contains by weight 30–75% Si, up to 12% Mg, up to 2.0% Ca, up to 1.5% Al, and up to 3.0% rare earth elements, of which cerium is the predominant element, with the balance being essentially iron. When MgFeSi is used as the FeSi based component, a preferred composition would be 3–12% Mg and 0.1–2.5% cerium.

The unalloyed Mg component of the invention should be at least 90% by weight of about ¼ inch and finer and is suitably sized 8 to 100 mesh. Milled Mg, shotted, or salt-coated Mg (90% Mg with chloride coating) and other sources of unalloyed magnesium can be used in the practice of the present invention.

The two components are blended by conventional blending techniques to provide an intimate mixture of the ferrosilicon and unalloyed magnesium components. The blend is then enclosed in a metal container, e.g., a steel can, which in turn is inserted into a standard foundry plunging bell for plunging into the molten base iron following conventional practice. The total magnesium content of the blend is suitably from 4 to 40% by weight, preferably 4 to 25% by weight.

In a particular test a mixture of 16.29 lb. of a 14 M×100 mesh magnesium ferrosilicon containing about 44.5% Si, 6.0% Mg, 0.6% Ca, 0.30% Ce, and 0.8% Al was blended with 3.86 lb. of 10×28 mesh milled unalloyed magnesium and placed in an open top steel can. When plunged into a 3600 lb. iron heat, the submerged can and mixture dissolved in the molten iron; the reaction time in the molten iron was 45 seconds and the total magnesium recovery was 33% (recovery of elemental magnesium was 31%).

Another test utilized 17.25 lb. of a ⅜ inch and finer MgFeSi that nominally contains 45% Si, 3.2% Mg, 2.0% total rare earth metals and 0.5% Ca. It was blended with 0.625 lb. of 10×25 mesh milled unalloyed magnesium and the mixture in an open top steel can was plunged in and submerged in a 1500 lb. iron heat. Total magnesium recovery was 50.6% (elemental magnesium recovery of 47.5%).

In each case, magnesium reactivity was far less than might have been expected from plunging this quantity of pure unalloyed Mg into molten iron. Microstructures of the iron showed excellent nodularity. The following example will further illustrate the present invention.

EXAMPLE

In a series of tests ferrosilicon base alloy (6% Mg, 4.45% Si, 0.6% Ca, 0.3% Ce, and 0.8% Al) in the amount of 16.29 pounds sized 14 mesh to 100 mesh was blended with milled magnesium sized 10×28 mesh in the amount of 3.86 pounds. The blended mixture was placed in open top cans made of thin gauge steel with each can containing 20.15 lb. of blended mixture. The cans were placed in a castable refractory bell and plunged and held submerged in a 3600 pound base iron melt (3.9% C, 1.9% Si, 0.020% S) which was at a temperature of about 1480° C. A further similar test was performed using a blended mixture of 20.74 pounds of magnesium ferrosilicon (containing 6% Mg, 44.5% Si, 0.6% Ca, 0.3% Ce and 0.8% Al) sized 14 to 100 mesh and salt-coated magnesium sized 10×100 mesh (90% Mg, 10% chloride salt coating). The results of these tests are shown in the Table hereinbelow. The magnesium recovery was measured as total magnesium in the iron product; the relative amounts of magnesium contributed by unalloyed magnesium, and magnesium from MgFeSi, are assumed to be in the same ratio as previously discussed.

TABLE

| | | Mg Input % | Mg Residual % | Total Mg Recovery % | Unalloyed Mg Recovery % |
|---|---|---|---|---|---|
| Test 1 | 16.29 Lb. 14M × 100M MgFeSi (6% Mg) 3.86 Lb. Milled Mg | 0.134 | 0.051 | 38.1 | 37.4 |
| Test 2 | 16.29 Lb. 14M × 100M MgFeSi (6% Mg) 3.86 Lb. Milled Mg | 0.134 | 0.042 | 31.3 | 29.0 |
| Test 3 | 16.29 Lb. 14M × 100M MgFeSi (6% Mg) 3.86 Lb. Milled Mg | 0.134 | 0.051 | 38.1 | 37.4 |
| Test 4 | 20.74 Lb. 14M × 100M MgFeSi (6% Mg) 4.22 Lb. Salt-Coated Mg (85% Mg) | 0.134 | 0.045 | 33.6 | 31.8 |

One of the main advantages of this invention is its flexibility. Once a foundry has established the amount of ferrosilicon component that will provide an acceptable level of Si for the base iron, the unalloyed magnesium component can be varied over quite a wide range to compensate for changes in base iron sulfur level, process temperatures, or other variables following known teaching of the art. Magnesium recoveries will usually decrease as the total magnesium content of the mixture increases. Above about 40% by weight total Mg, there is inadequate ferrosilicon or MgFeSi to moderate the magnesium reaction rate at an acceptable pace leading to low magnesium recoveries.

To retain maximum flexibility, blending of the two components is preferably done by the user of the process. However, premixed or prepackaged blends can also be used.

The ferrosilicon base alloy component of the present invention contains 30–75% Si, up to 12% Mg, up to 2% Ca, up to 3% rare earths and up to 1.5% Al. The mesh sizes referred to herein are Tyler Series. Containers suitable in the practice of the present invention are those which have sufficient integrity to contain the blend prior to plunging into molten iron and which will melt, burn, or dissolve in the molten base iron. Iron base alloys, e.g., steels, are generally the most practical although aluminum and aluminum base alloys and other commonly available metals can be used which do not introduce undesired impurities into the product iron.

What is claimed is:

1. A method for adding magnesium to a molten base iron which comprises preparing a blended mixture consisting essentially of unalloyed magnesium metal suitably sized about ¼" and finer with ferrosilicon base alloy suitably sized to ⅜" and finer; placing blended mixture in a suitable container; and plunging said container beneath molten base iron, the amount of unalloyed magnesium metal in said mixture being from about 4% to 40% by weight of the weight of said ferrosilicon base alloy and unalloyed magnesium.

2. A method in accordance with claim 1 wherein the amount of unalloyed magnesium is from about 4 to 25% by weight.

3. A method in accordance with claim 1 wherein said unalloyed magnesium is sized from about 8 to 100 mesh and said ferrosilicon base alloy is sized from 8 to 200 mesh.

4. A method in accordance with claim 1 wherein the ferrosilicon base alloy is a magnesium ferrosilicon containing from 3–12% magnesium and 0.1 to 2.5% cerium.

* * * * *

UNITED STATES PATENT AND TRADEMARK OFFICE

CERTIFICATE OF CORRECTION

PATENT NO. : 4,313,758

DATED : February 2, 1982

INVENTOR(S) : William A. Henning and Henry F. Linebarger

It is certified that error appears in the above-identified patent and that said Letters Patent are hereby corrected as shown below:

Column 1, line 62, after the term "4%" insert the chemical symbol --C--.

Signed and Sealed this

*Twenty-fifth* Day of *June 1985*

[SEAL]

*Attest:*

DONALD J. QUIGG

*Attesting Officer*

*Acting Commissioner of Patents and Trademarks*